US010378810B2

(12) United States Patent
Na et al.

(10) Patent No.: US 10,378,810 B2
(45) Date of Patent: Aug. 13, 2019

(54) ECO-FRIENDLY ICE PACK TO BE EASILY SEPARATED AND DISCHARGED

(71) Applicants: Jung Kyun Na, Hwaseong-si (KR); Seok Choi, Hwaseong-si (KR)

(72) Inventors: Jung Kyun Na, Hwaseong-si (KR); Seok Choi, Hwaseong-si (KR)

( * ) Notice: Subject to any disclaimer, the term of this patent is extended or adjusted under 35 U.S.C. 154(b) by 0 days.

(21) Appl. No.: 15/862,632

(22) Filed: Jan. 5, 2018

(65) Prior Publication Data

US 2019/0128585 A1 May 2, 2019

(30) Foreign Application Priority Data

Oct. 31, 2017 (KR) ..... 10-2017-0144183

(51) Int. Cl.
*F25D 3/08* (2006.01)
*B65D 81/18* (2006.01)

(52) U.S. Cl.
CPC ..... *F25D 3/08* (2013.01); *B65D 81/18* (2013.01); *F25D 2331/80* (2013.01)

(58) Field of Classification Search
CPC ..... F25D 3/08; F25D 2332/80; B65D 81/18
See application file for complete search history.

(56) References Cited

U.S. PATENT DOCUMENTS 2,595,328 A * 5/1952 Bowen ..... A61F 7/02 165/46
3,175,558 A * 3/1965 Caillonette ..... A61F 7/03 126/204
4,232,552 A * 11/1980 Hof ..... G01K 11/06 116/201
4,343,158 A * 8/1982 Campbell ..... A61J 1/165 383/110
5,490,396 A * 2/1996 Morris ..... B65D 81/18 383/110
6,125,645 A * 10/2000 Horn ..... A41D 13/0056 2/458
6,170,268 B1 * 1/2001 Elfert ..... F25D 13/067 62/320
6,251,131 B1 * 6/2001 Kohout ..... A61F 7/103 607/114

(Continued)

FOREIGN PATENT DOCUMENTS

KR 20-0391355 Y1 8/2005

*Primary Examiner* — Kun Kai Ma
(74) *Attorney, Agent, or Firm* — Revolution IP, PLLC

(57) ABSTRACT

Disclosed herein is an eco-friendly ice pack, which includes a water repellent material that maintains the shape of the ice pack and does not absorb a refrigerant, so that it can be easily separately discharged after use of the ice pack. In accordance with the present invention, the above and other objects can be accomplished by the provision of an eco-friendly ice pack including a refrigerant including a phase change material changing phase according to temperature, an outer case including the refrigerant and being formed by sealing in order to prevent the refrigerant from being discharged to the outside, and a water repellent supporter being disposed in the outer case, holding the shape of the ice pack to prevent the shape of the ice pack from being changed according to the shape of the refrigerant, and having water repellency to the refrigerant to avoid mixing with the refrigerant.

9 Claims, 5 Drawing Sheets

(56) References Cited

U.S. PATENT DOCUMENTS

| | | | | |
|---|---|---|---|---|
| 6,253,570 | B1 * | 7/2001 | Lustig | A45C 15/00 62/125 |
| 7,240,513 | B1 * | 7/2007 | Conforti | A45C 13/02 62/457.2 |
| 2002/0039867 | A1 * | 4/2002 | Curro | A47L 1/15 442/373 |
| 2006/0081000 | A1 * | 4/2006 | Trinh | A61F 7/103 62/530 |
| 2007/0026228 | A1 * | 2/2007 | Hartmann | D01F 1/08 428/402.2 |
| 2008/0066491 | A1 * | 3/2008 | Russo | B65D 33/00 62/530 |
| 2008/0140166 | A1 * | 6/2008 | von Hoffman | A61F 7/02 607/108 |
| 2010/0025009 | A1 * | 2/2010 | Klett | F28D 15/0241 165/46 |
| 2010/0064720 | A1 * | 3/2010 | Fuchs | F25C 1/22 62/457.7 |
| 2013/0340953 | A1 * | 12/2013 | Knutson | E06B 3/80 160/236 |
| 2015/0144522 | A1 * | 5/2015 | Hibben | B65D 25/14 206/524.3 |
| 2016/0122115 | A1 * | 5/2016 | Peppou | B01D 53/28 62/4 |
| 2018/0299059 | A1 * | 10/2018 | McGoff | F16L 59/00 |
| 2018/0325723 | A1 * | 11/2018 | Shih | A61F 7/007 |

* cited by examiner

ECO-FRIENDLY ICE PACK TO BE EASILY SEPARATED AND DISCHARGED

BACKGROUND OF THE INVENTION

Field of the Invention

The present invention relates to an eco-friendly ice pack to be easily separated and discharged, and more particularly, to an eco-friendly ice pack that includes, in an ice pack package, a water repellent material that does not absorb a refrigerant while maintaining the shape of the ice pack, so that it can be easily separated and discharged after use.

Description of the Related Art

With the recent development of transport business, conventional cargo that does not have a shelf life as well as foods that require fast delivery can be transported. Foods should be stored at low temperature to maintain freshness, because they are quickly decomposed when exposed to normal temperature.

Therefore, for food transportation, a storage means for freezing and refrigeration is separately needed in addition to a transportation means. However, when separately transporting small amounts of foods, rather than transporting large amounts of food materials, frozen foods and the like, dry ice or ice packs are incorporated in boxes containing foods in order to prevent food spoilage.

Dry ice is a coolant which is made of solid carbon dioxide formed by compressing gaseous carbon dioxide. Such dry ice is not readily available because it requires a separate manufacturing process. Since its temperature is below −78° C., touching dry ice with bare hands may cause frostbite. For this reason, care is needed for handling and storage of it. In addition, dry ice is a one-time coolant that sublimes and disappears unless it is stored at a temperature of −78° C. or less, thus having low efficiency.

On the other hand, an ice pack contains a refrigerant having a high specific heat and is used in a frozen form of a mixture of the refrigerant with water, so that the surroundings can be maintained at low temperature through endothermic action of the ice pack. Ice packs are widely used because they are easy to handle and store, unlike dry ice, and can be used semi-permanently.

Since excess ice packs unnecessarily occupy a space inside the refrigerator, they need to be disposed of. However, when ammonium nitrate or ammonium chloride is used as a refrigerant, the ammonium nitrate and ammonium chloride are difficult to dispose of because they are harmful substances. When a superabsorbent polymer made of an eco-friendly substance is used as a refrigerant, it is maintained in the form of a gel combined with water, so that a user can dispose of it by discharging into a sewer pipe. However, this can cause a side effect of clogging the sewer pipe.

Because of the problems, an ice pack states, on a case thereof, that the ice pack should be disposed of as a general garbage. However, users often separately dispose of the refrigerant and the case, without reading this statement, because the case is made of vinyl. In addition, even if the ice pack is disposed of as general waste, separate disposal of the ice pack is needed, which leads to a problem in that disposal of the ice pack is cumbersome.

However, an ice pack, which is easy to dispose of, has not been developed to date. Korean Utility Model Publication No. 20-0391355 discloses, as a flash-cooling gel pack, an ice pack having a structure, in which a separate substance is contained, which can be mixed with a refrigerant by a user, if necessary.

The prior art provides an instantaneous-cooling gel pack that is composed of a shell made of a synthetic resin film, a separate pack sealed in the shell and containing water, and a mixture of a heat-absorbing powder and a natural water-soluble polymer powder, which is sealed in the shell, and that maintains a gel state that exhibits a flash cooling effect through instantaneous one-touch operation without using a facility, such as a freezer, by mixing the water with the heat-absorbing powder in the pack through one-touch operation when used. However, in the prior art, there is no description about a means for solving the problems that occur when disposing of the ice pack mentioned above, and there is a high possibility that the separate pack may be broken by exterior power without users' intention, since the separate pack sealed in the shell is simply broken in a one-touch manner for use.

Therefore, there is a need for an ice pack that can solve the problems caused by disposal of the ice pack, and has a separate configuration in which it contains a separate material which is isolated from a refrigerant and allows a user to directly mix the separate material with the refrigerant only when the user wants to dispose of the ice pack, while preventing the separate material in the ice pack from being mixed with the refrigerant by exterior force.

PRIOR ART DOCUMENT

Patent Document (Patent Document 0001) Korean Utility Model Publication No. 20-0391355 (2005 Aug. 1)

SUMMARY OF THE INVENTION

Therefore, the present invention has been made in view of conventional problems and it is one object of the present invention to provide an eco-friendly ice pack that includes, in an ice pack package, a water repellent material that maintains the shape of the ice pack and does not absorb a refrigerant, so that it can be easily separately discharged after use of the ice pack.

In accordance with the present invention, the above and other objects can be accomplished by the provision of an eco-friendly ice pack including a refrigerant including a phase change material changing phase according to temperature, an outer case including the refrigerant and being formed by sealing in order to prevent the refrigerant from being discharged to the outside, and a water repellent supporter being disposed in the outer case, holding the shape of the ice pack to prevent the shape of the ice pack from being changed according to the shape of the refrigerant, and having water repellency to the refrigerant to avoid mixing with the refrigerant.

In addition, the water repellent supporter may include a polyester material.

In addition, the water repellent supporter may be a polyester foam produced by processing fibers including the polyester material into a sheet and thermally fusing the sheet.

In addition, fibers made of the polyester material used for processing into the sheet may be 100% polyester fibers extracted from recyclable polyethylene terephthalate (PET) bottles and the formation of the polyester foam by heat fusion may be carried out without using an adhesive agent.

In addition, the polyester foam may have a thickness of 10 to 100 millimeters (mm) and a density of 16 to 280 kg/$m^2$.

In addition, the polyester foam may have a thermal conductivity of 0.031 to 0.040 w/mk and a heat-resistant temperature of 260° C.

In addition, the water repellent supporter may be a polyethylene or polystyrene foam produced using a polyethylene or polystyrene material.

In addition, the refrigerant including the phase change material may be water ($H_2O$) and the water repellent supporter may be present in an amount of 2 to 4% by weight in the ice pack.

In addition, the outer case may include a nylon and polyethylene material.

In addition, the eco-friendly ice pack may further include a non-woven fabric layer formed on an outer surface of the outer case made of nylon and polyethylene so as to prevent water from being produced on the outside of the ice pack.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
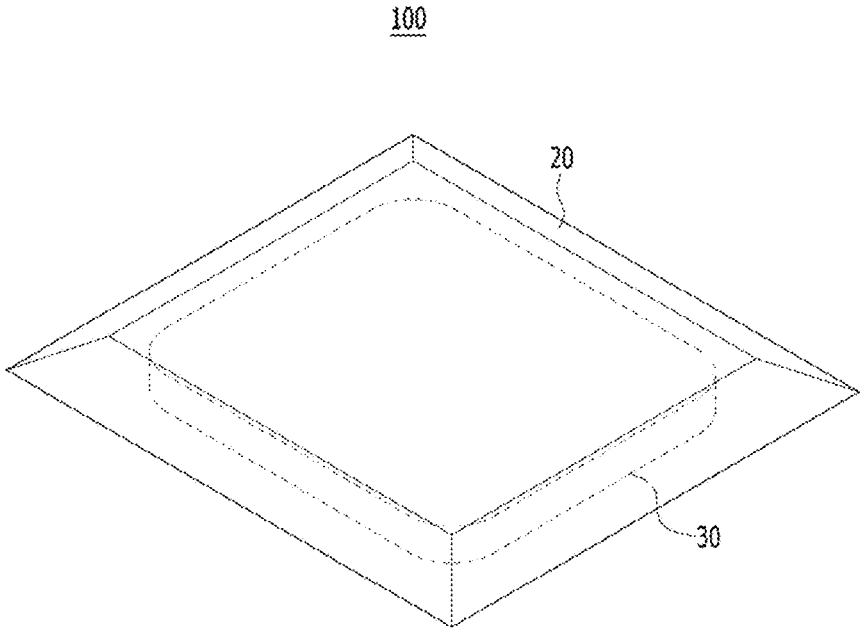
FIG. 1 is a perspective view illustrating an eco-friendly ice pack according to an embodiment of the present invention.
Figure 2:
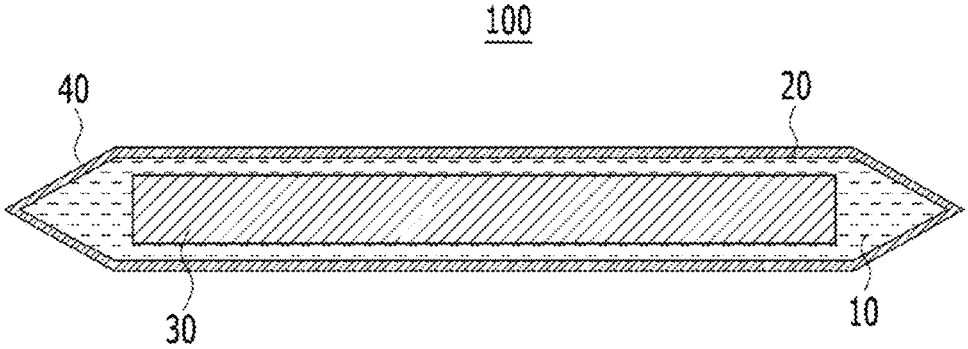
FIG. 2 is a sectional view illustrating an eco-friendly ice pack according to an embodiment of the present invention.

The eco-friendly ice pack according to an embodiment of the present invention includes a refrigerant including a phase change material that changes phase. The refrigerant functions to cool the ice pack and can be any material that changes phase (solid, liquid or gas) according to temperature. Among phase change materials, water is a substance that changes phase from a liquid to a solid, when the temperature gradually decreases from room temperature and reaches 0° C., and a paraffinic material is a substance that changes phase from a liquid to a solid when the temperature gradually decreases from room temperature and reaches 5° C. This phase change material can utilize various materials as described above as a refrigerant depending on usage purpose of the ice pack, such as, food storage, food transportation and medical use.

The eco-friendly ice pack according to the present invention includes the refrigerant and further includes an outer case which is formed by sealing in order to prevent the refrigerant from being discharged to the outside. In this case, the outer case preferably includes nylon and polyethylene. The eco-friendly ice pack may further include a non-woven fabric layer which is formed on the outer surface of the outer case made of nylon and polyethylene so as to prevent water from being produced on the outer surface of the ice pack.

Polyethylene (PE) is heat-resistant and is widely used in kitchen appliances, is used in various products due to high workability and may be a main ingredient of PET bottles. In addition, PE undergoes almost no discoloration even when exposed to sunlight for a long time and is also used for children's toys due to relative safety thereof.

Polyethylene (PE) may be classified into high-density polyethylene, low-density polyethylene, medium-density polyethylene, super-high-density polyethylene and super-low-density polyethylene. The low-density polyethylene (LDPE) is a synthetic resin produced by polymerizing ethylene, is a transparent solid at room temperature (density of 0.91 to 0.94) and is used as a raw material for transparent films for agricultural and packaging, electric cable coatings and various wraps due to low crystallinity and thus excellent workability, flexibility and transparency.

Nylon is a generic term for polyamide (a polymer compound having an amide bond of —CONH) that takes the form of linear synthetic polyamide and is roughly classified into two types. m,n-nylon (or nylon mn) is a polycondensation product of diamine, $NH_2$ $(CH_2)mNH_2$, having m carbons with dibasic acid, $HOOC(CH_2)_n$—2 COOH, having n carbons, and 6,6-nylon, 6,10-nylon and the like are industrially produced. n-nylon (or nylon n) is a polycondensation product or polymer of co-amino acid, $H_2N(CH_2)_nCOOH$ having n carbon atoms or lactam, and 6-nylon, 11-nylon and the like are industrially produced. In addition, a copolymer of caprolactam and a 6,10-nylon salt (hexamethylenediamine and sebacate), so-called, copolymerized nylon, is industrially produced.

Nylon has excellent impact resistance, and mechanical properties thereof such as tensile strength, yield point and hardness are greatly influenced by crystallinity which varies depending on molding method, molding conditions, heat treatment and the like. Nylon is not dissolved in common organic solvents and is strongly resistant to alkali, but it is dissolved and hydrolyzed in strong acids. As the solvent, phenols such as phenol, m-cresol, formic acid and the like are used. Since nylon is weakened by ultraviolet light, a product containing an ultraviolet absorber is used for outdoor applications.

Nonwoven fabrics are formed in the form of a felt by arranging in a parallel or random direction and bonding with a synthetic resin adhesive without performing a weaving process. Cotton and viscose rayon were used as raw fibers at the first time and other synthetic fibers have also been recently used.

Processing methods include immersion and drying. Immersion is also called paper-making. Fibers are dipped in a synthetic resin adhesive container and then dried and heat-treated, which is similar to how paper is produced. The drying includes spraying a synthetic resin onto thin cotton-like fibers, followed by heating and drying. Napkins, medical wicks, filters and the like are used and also developed for construction applications such as soil stabilization and dust-proofing materials.

The eco-friendly ice pack according to the present invention includes a water repellent supporter that is disposed inside the outer case, holds the shape of the ice pack to prevent the shape of the ice pack from being changed according to the shape of the refrigerant, and has water repellency to the refrigerant to avoid mixing with the refrigerant.

The water repellent supporter may include a polyester material. More preferably, the water repellent supporter may be a polyester foam which is produced by processing fibers including the polyester material into a sheet and thermally fusing the sheet.

The characteristics of the polyester material are as follows. First, polyester can be easily reused and incinerated and does not produce particulates, thus solving environmental problems. Second, there is no damage to products during transportation and handling, and it can be easily worked and handled because no protective equipment is required. Third, it is harmless to humans and can be used for clothing and food storage materials. Fourth, it has excellent tensile strength and bonding strength, and short draining time and maintains insulation without any change. Fifth, it is a self-extinguishing organic material and its shape is generally changed at 260° C., so it has excellent heat resistance. Sixth, it is not worn due to strong bonding strength even if exposed to air for a long time. Seventh, it undergoes almost no scattering by weathering, thus having no problem of air pollution.

Further, fibers made of the polyester material used for processing into the sheet are 100% polyester fibers extracted from recyclable polyethylene terephthalate (PET) bottles, and an adhesive agent may not be used to form polyester foams by heat fusion.

Figure 3:
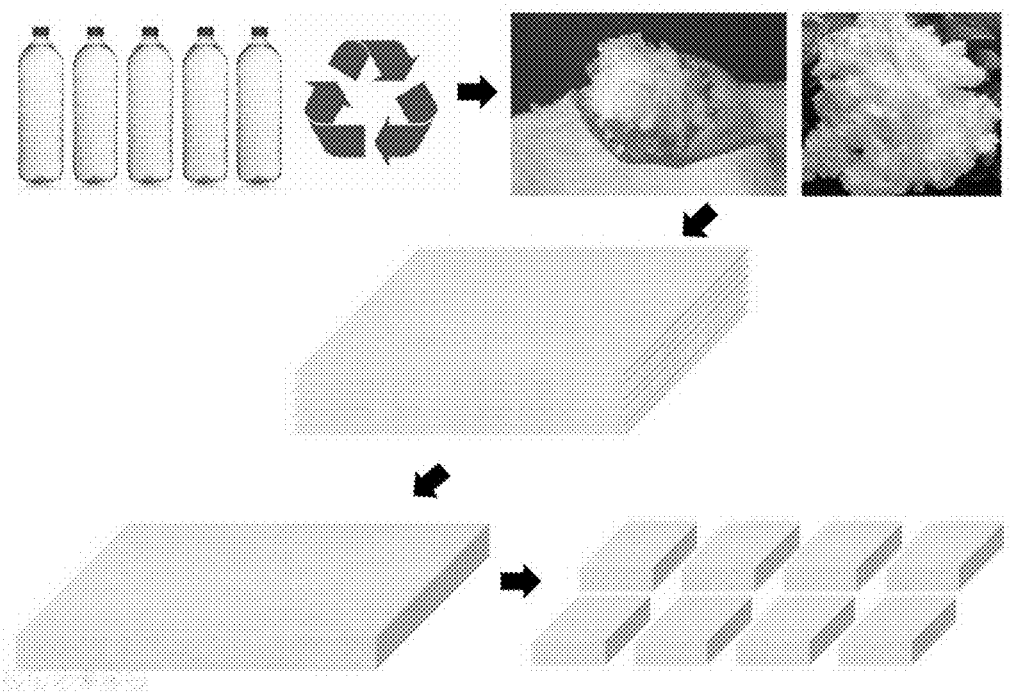
FIG. 3 shows a process for producing a water repellent supporter of the eco-friendly ice pack according to the embodiment of the present invention.

As shown in FIG. 3, first, polyester fibers used as a material for polyester foams are extracted. Polyester fibers are preferably derived from recyclable polyethylene terephthalate (PET) bottle materials. PET bottles are containers made of polyethylene terephthalate, which are increasingly produced because they are considered to be lightweight, non-brittle, transparent and safe in terms of food hygiene, and are widely used as soft drink, soy sauce and other seasoning containers. When commonly used PET bottles are recycled, these bottles have advantages of being easily separately collected and recycled after use, compared to conventional ice packs requiring high costs for disposal.

100% polyester fibers extracted from recycled PET bottles are processed into the form of a polyester sheet again. A plurality of pieces of polyester fibers spread widely in the sheet form are stacked and are then thermally bonded to form a polyester foam.

In this case, the polyester foam preferably has a thickness of 10 to 100 millimeters (mm) and a density of 16 to 280 $kg/m^2$, and most preferably has a thermal conductivity of 0.031 to 0.040 w/mk, and a heat-resistant temperature of 260° C. As a result of various experiments, the effect of maintaining the cooling capacity of the eco-friendly ice pack according to the present invention can be maximized. The polyester foam thus formed is cut to the final product size according to the size of the ice pack.

The water repellent supporter according to the present invention may be a polyethylene or polystyrene foam produced using a polyethylene or polystyrene material.

Regarding the eco-friendly ice pack according to the present invention, the weight of the water repellent supporter is preferably 2 to 4% by weight, more preferably, 3% by weight or less, with respect to the total weight of the ice pack. When an ice pack is produced based on 500 g of water, 12 to 14 g of a polyester foam which is a water repellent supporter is preferably mixed with 486 to 488 g of water as a refrigerant.

Hereinafter, a method for disposing of the used eco-friendly ice pack according to the present invention will be described. In the prior art, a super-absorbent resin (super-absorbent polymer) that absorbs water was used in combination with a refrigerant (water) in the ice pack. In this case, since the super-absorbent resin maintains the form of a gel combined with water, a user disposes of the resin by discharging the same into a sewer pipe, which causes a side-effect of clogging the sewer pipe.

Due to this problem, a case of an ice pack states that the ice pack should be disposed of as general garbage. However, users often separately dispose of the refrigerant and the case, without reading this statement, because the case is made of vinyl. In addition, even though the ice pack is disposed of as general waste, separate disposal of the ice pack is needed, which leads to a problem in that disposal of the ice pack is cumbersome.

In addition, in order to solve such a problem, some waste disposal companies collect ice packs and separate the refrigerant (water) from super absorbent resins in bulk to dispose of the same. However, in this case, there is a problem of low economic efficiency, compared to the price of ice packs.

However, since the eco-friendly ice pack according to the present invention uses a material (preferably, a polyester foam) that does not absorb a refrigerant in the ice pack, but has repellency to the refrigerant, any general consumer can easily remove water from the ice pack by pouring in the case of discharging the refrigerant (water) through a hole formed in the outer case or a cut edge part after use of the ice pack. In this process, the polyester foam as the water-repellent material is easily separated from the outer case and simply disposed of.

In addition, since the polyester foam is made of 100% recycled PET, it can be recycled immediately, like the outer case, which makes it easy for anyone to use and dispose of. In order to facilitate discharge of the refrigerant (water) during the disposal of the eco-friendly ice pack according to the present invention, a refrigerant inlet/outlet (not shown) may be formed in advance. In this case, when replacing only the refrigerant, while maintaining the outer case and the polyester foam, a new refrigerant can be injected into the ice pack, whereas the existing refrigerant is discharged through the inlet/outlet. All of these processes are available because a water-repellent material (preferably a polyester foam) not mixed with a refrigerant (water) is contained in the ice pack without using a polymer that absorbs water inside the ice pack, like the eco-friendly ice pack according to the present invention.

In addition, since conventional products are in the form of a gel, molds are not formed as a cube when frozen, making it difficult to handle and store. These products inefficiently occupy an inner space due to their irregular frozen shapes when inserted into the packaging. On the other hand, the eco-friendly ice packs have an advantage in that they are frozen in the shape of the polyester foam and thus can most efficiently use the inner space owing to maximum flatness and a certain frozen shape like a hexahedron when inserted into packaging.

In addition, the conventional product has a problem in that the shape of the product is irregular and energy efficiency is thus lowered due to irregular coldness or heat emission. On the other hand, since the eco-friendly ice pack according to the present invention is formed into a certain hexahedral shape, it is possible to increase energy efficiency.

Figure 4:
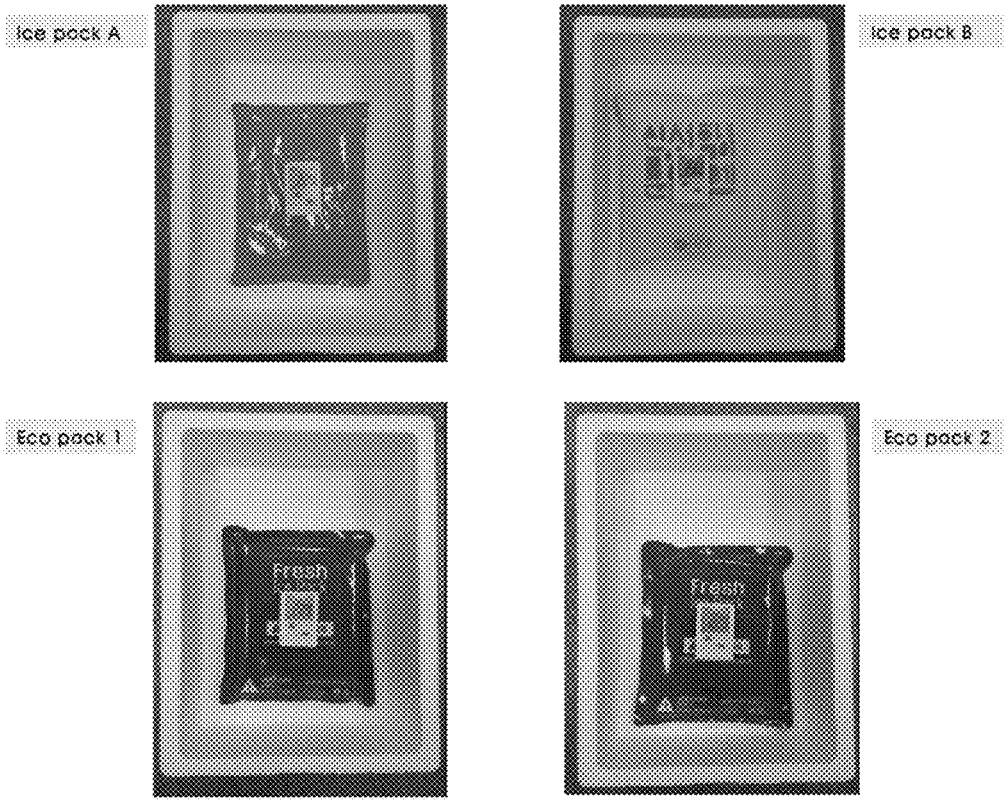
FIG. 4 is an image showing a testing process of refrigerant retention time with respect to the eco-friendly ice pack according to the present invention and a conventional ice pack.

In FIG. 4, the ice pack A is composed of an outer case made of nylon and polyethylene and containing a refrigerant (water) and a super-absorbent polymer, like a conventional ice pack, and the ice pack B further includes a nonwoven fabric layer formed in the ice pack A.

On the other hand, Eco packs 1 and 2 both have an outer case made of nylon and polyethylene, which includes a refrigerant (water) and a polyester foam inside the ice pack. Four icepacks were tested under the same conditions.

Eco packs 1 and 2 relate to the ice pack according to the present invention, which were tested with the same configuration in order to prevent an error in test result figures. The outer temperature of the testing environment was maintained at 22 to 25° C. and the test time was set to 24 hours. In order to avoid errors and variables, the weight of all of the four ice packs was adjusted to 500 g, and the error range of the weight was ±1%.

Figure 5:
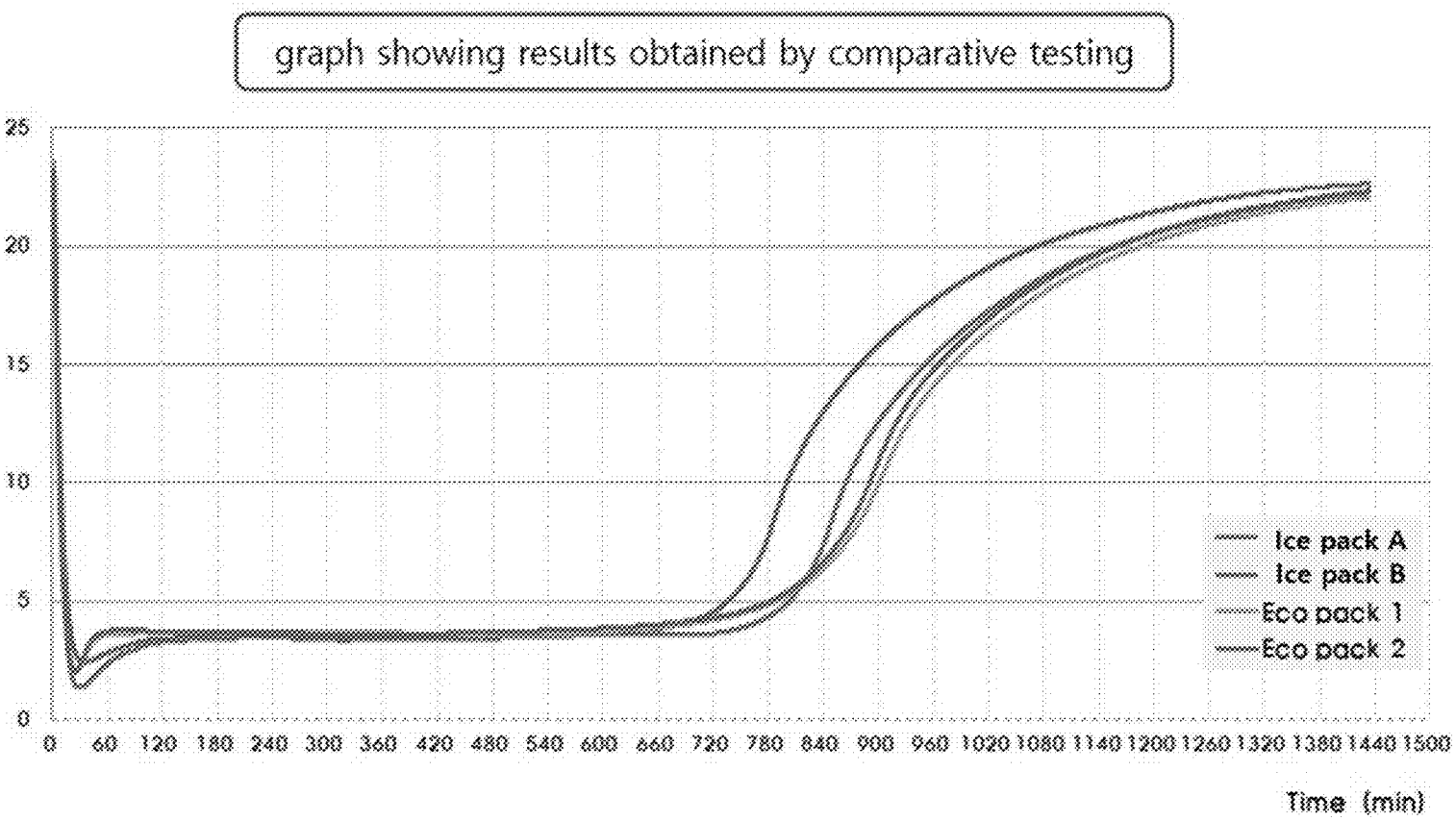
FIG. 5 is a graph showing results obtained by comparative testing of FIG. 4.

As can be seen from FIG. 5, the cooling capacity is kept constant for all four ice packs until 11 hours (660 minutes). It can be seen that the cooling capacity of Eco packs 1 and 2 is comparable or superior to ice packs A and B until 24 hours (1,440 minutes). The ice pack A was maintained at 10° C., which was a general target temperature of the ice pack, for 14 hours and the ice pack B was maintained at the target temperature for 13 hours. On the other hand, the target temperature of the ice packs 1 and 2 was maintained for 15 hours, which has a 15% improvement in overall performance compared to the conventional ice pack. As can be seen from the above results, the eco-friendly ice pack according to the present invention can be easily disposed of after use, because it is manufactured only from an eco-friendly material, thereby solving environmental problems. In addition, the eco-friendly ice pack has excellent economic efficiency due to no additional disposal cost, and is better than the conventional ice pack, when it comes to maintaining cooling capacity which is the basic property of ice packs. Accordingly, the eco-friendly ice pack according to the present invention has better effects than the conventional ice pack, which means that the eco-friendly ice pack according to the present invention is technically superior to the conventional ice pack in all respects.

Figure 6:
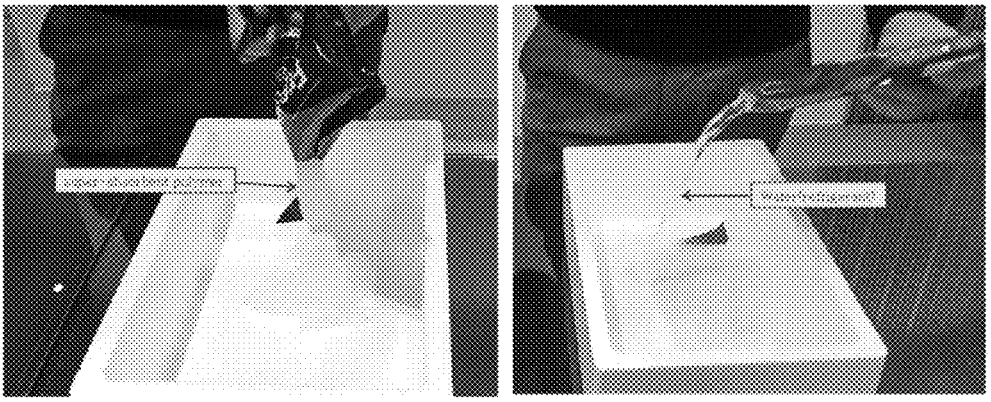
FIG. 6 is an image showing comparison in separate discharge process between the conventional ice pack and the ice pack according to the present invention.

The left image of FIG. 6 shows a process of separating and discharging the conventional ice pack. As shown in the image, regarding the conventional ice pack, when the inside of the case is cut and the inner contents are discharged, a super-absorbent polymer having refrigerant (water) is discharged. Such a superabsorbent polymer has a side effect of clogging the sewer owing to the property of absorbing the refrigerant (water) upon discharge into the sewer. Therefore, the conventional ice pack cannot be disposed by a final consumer and should be collected by an ice pack supplier or distributor and then subjected to a mass-disposal process, thus causing environmental problems and serious economic damage in the disposal process.

On the other hand, the right image of FIG. 6 shows a separating and discharging the ice pack according to the present invention. As can be seen from the image, since the eco-friendly ice pack according to the present invention discharges a water-repellent support (not shown) having a repellence to the refrigerant (water) in the ice pack, it can easily discharge water immediately after cutting a part of the case, and the outer case and the inner water-repellent support (preferably, polyester foam) can be easily separately collected and disposed of by final consumers. Such a process can solve environmental problems and an advantageous economic effect can be obtained, since there is no disposal process for a separate superabsorbent polymer. In addition, the conventional ice pack uses only an absorbent material that absorbs the refrigerant. On the other hand, the present invention suggests a configuration completely turning the conventional concept by using a water-repellent material that does not absorb the refrigerant (water).

The eco-friendly ice pack according to the present invention can be easily separated and discharged after use by including, in an ice pack package, a water repellent material that does not absorb a refrigerant, while maintaining the shape of the ice pack.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An eco-friendly ice pack comprising:

a refrigerant comprising a phase change material changing phase according to temperature;

an outer case enclosing the refrigerant and being formed by sealing in order to prevent the refrigerant from being discharged to the outside; and a water repellent supporter being disposed in the outer case, holding the shape of the ice pack to prevent the shape of the ice pack from being changed according to the shape of the refrigerant, and having water repellency to the refrigerant to avoid mixing with the refrigerant, wherein the water repellent supporter comprises a polyester material, wherein the water repellent supporter is a polyester foam produced by processing fibers comprising the polyester material into a sheet and thermally fusing the sheet, and wherein the fibers made of the polyester material used for processing into the sheet are 100% polyester fibers extracted from recyclable polyethylene terephthalate (PET) bottles, and a formation of the polyester foam by heat fusion is carried out without using an adhesive agent.

2. The eco-friendly ice pack according to claim 1, wherein the polyester foam has a thickness of 10 to 100 millimeters (mm) and a density of 16 to 280 kg/m2.

3. The eco-friendly ice pack according to claim 2, wherein the polyester foam has a thermal conductivity of 0.031 to 0.040 w/mk, and a heat-resistant temperature of 260° C.

4. The eco-friendly ice pack according to claim 1, wherein the refrigerant comprising the phase change material is water (H2O), and the water repellent supporter is present in an amount of 2 to 4% by weight in the ice pack.

5. The eco-friendly ice pack according to claim 4, wherein the outer case comprises a nylon and polyethylene material.

6. The eco-friendly ice pack according to claim 5, further comprising a non-woven fabric layer formed on an outer surface of the outer case made of nylon and polyethylene so as to prevent water from being produced on the outside of the ice pack.

7. The eco-friendly ice pack according to claim 1, wherein the refrigerant comprising the phase change material is water (H2O), and the water repellent supporter is present in an amount of 2 to 4% by weight in the ice pack.

8. The eco-friendly ice pack according to claim 2, wherein the refrigerant comprising the phase change material is water (H2O), and the water repellent supporter is present in an amount of 2 to 4% by weight in the ice pack.

9. The eco-friendly ice pack according to claim 3, wherein the refrigerant comprising the phase change material is water (H2O), and the water repellent supporter is present in an amount of 2 to 4% by weight in the ice pack.

* * * * *